US009041747B2

(12) United States Patent
Tanaka

(10) Patent No.: US 9,041,747 B2
(45) Date of Patent: May 26, 2015

(54) DISPLAY CONTROL APPARATUS

(75) Inventor: Toshio Tanaka, Kobe (JP)

(73) Assignee: FUJITSU TEN LIMITED, Kobe (JP)

( * ) Notice: Subject to any disclaimer, the term of this patent is extended or adjusted under 35 U.S.C. 154(b) by 470 days.

(21) Appl. No.: 13/422,780

(22) Filed: Mar. 16, 2012

(65) Prior Publication Data

US 2012/0242716 A1 Sep. 27, 2012

(30) Foreign Application Priority Data

Mar. 23, 2011 (JP) ..... 2011-064040

(51) Int. Cl.

| | |
|---|---|
| ***G09G 5/10*** | (2006.01) |
| ***G09G 3/34*** | (2006.01) |
| ***H05B 33/08*** | (2006.01) |
| ***G09G 3/36*** | (2006.01) |

(52) U.S. Cl.

CPC .. *G09G 3/34* (2013.01); *G09G 5/10* (2013.01); *H05B 33/0854* (2013.01); *G09G 3/36* (2013.01); *G09G 2320/0271* (2013.01); *G09G 2320/0633* (2013.01); *G09G 2320/064* (2013.01); *G09G 2320/066* (2013.01); *G09G 2360/144* (2013.01); *G09G 2380/10* (2013.01)

(58) Field of Classification Search

USPC ..... 345/690, 76

See application file for complete search history.

(56) References Cited

U.S. PATENT DOCUMENTS

| | | | | |
|---|---|---|---|---|
| 5,446,504 | A * | 8/1995 | Wada | 348/645 |
| 5,493,622 | A * | 2/1996 | Tsuchino et al. | 382/132 |
| 6,380,915 | B1 * | 4/2002 | Teremy et al. | 345/76 |

FOREIGN PATENT DOCUMENTS

| | | |
|---|---|---|
| JP | B2-3527620 | 5/2004 |
| JP | A-2005-182232 | 7/2005 |
| JP | A-2005-308792 | 11/2005 |
| JP | A-2007-281767 | 10/2007 |
| JP | A-2009-146893 | 7/2009 |
| JP | A-2009-276425 | 11/2009 |

OTHER PUBLICATIONS

Japanese Office Action issued in Japanese Patent Application No. 201210038974.X dated Jan. 30, 2014 (w/ translation).

* cited by examiner

*Primary Examiner* — Fred Tzeng
(74) *Attorney, Agent, or Firm* — Oliff PLC

(57) ABSTRACT

When illuminance E by external light is lower than a high threshold Th, a backlight controller performs a duty cycle control that adjusts an amount of light of the backlight by changing a duty cycle of the control signal in accordance with the illuminance amount by the external light while maintaining the control signal at a constant level. When the illuminance E by the external light is higher than the high threshold Th, the backlight controller performs a pulse control that causes the backlight to periodically emit a pulsed light by making the level of the control signal higher than the level of the control signal in the duty cycle control while fixing the duty cycle of the control signal at a predetermined value or lower.

20 Claims, 10 Drawing Sheets

DISPLAY CONTROL APPARATUS

BACKGROUND OF THE INVENTION

1. Field of the Invention

The invention relates to a control technology relating to display method of a display apparatus.

2. Description of the Background Art

When external light is incident on a screen of a display apparatus, visibility of the display apparatus may be reduced due to the external light. Therefore, technologies have been conventionally proposed to adjust a displaying state of the display apparatus in accordance with an illuminance amount by the external light.

For example, when the screen of the display apparatus is exposed to the relatively bright external light, the visibility of the screen of the display apparatus is reduced due to reflection of the external light and the like. Therefore, a technology that improves the visibility by correcting an image to increase average brightness of the image while maintaining an amount of light of a backlight of the display apparatus at a relatively high value, when the illuminance amount by the external light is relatively high, has been conventionally proposed.

The screen of the display apparatus, such as a vehicle-mounted display apparatus, to be used at various times of a day at various places may be exposed to external light, such as direct sunlight, by which an illuminance amount of the screen may be significantly high while in use. There are limitations to light-emission performance of the backlight. Therefore, it is difficult to improve the visibility of the display apparatus by increasing an amount of light (light amount) of the backlight in such a case where the illuminance amount by the external light is significantly high (e.g., higher than 20,000 1×). Thus, a technology that improves visibility of a display apparatus when an illuminance amount by external light is high, has been requested.

SUMMARY OF THE INVENTION

According to one aspect of the invention, a display control apparatus controls a display apparatus. The display control apparatus includes: an acquisition part that acquires an illuminance amount by external light on a screen of the display apparatus; a first generator that generates a correction image by compressing a dynamic range of an original image for display on the display apparatus; an output part that outputs a display image generated by using at least one of the original image and the correction image, to the display apparatus and that causes the display image to be displayed on the display apparatus; and a controller that provides a periodic control signal to a backlight illuminating the screen to control light emission of the backlight. When E denotes the illuminance amount by the external light and when Th denotes a threshold relating to the illuminance amount by the external light, in a case where $E<Th$, the controller performs a first control that adjusts an amount of light of the backlight by changing a duty cycle of the control signal in accordance with the illuminance amount by the external light while maintaining a level of the control signal constant, and in a case where $Th<E$, the controller performs a second control that causes the backlight to periodically emit a pulsed light by making the level of the control signal higher than the level of the control signal in the first control while fixing the duty cycle of the control signal.

When the illuminance amount by the external light is relatively high, the control that causes the backlight to periodically emit the pulsed light is performed while the display image generated by using at least one of the original image and the correction image generated by compressing the dynamic range of the original image is displayed on the display apparatus. Thus, the display control apparatus is capable of increasing user-perceived brightness of the screen of the display apparatus, and visibility of the display apparatus when the illuminance amount by the external light is high can be improved.

According to another aspect of the invention, the display control apparatus further includes a second generator that generates the display image by combining the original image and the correction image in a combining ratio determined in accordance with the illuminance amount by the external light.

The display image appropriate to the illuminance amount by the external light can be displayed on the display apparatus because the display image is generated by combining the original image and the correction image in the combining ratio determined in accordance with the illuminance amount by the external light.

According to another aspect of the invention, the display apparatus is an apparatus for installation in a vehicle.

The visibility of the display apparatus can be improved in a vehicle on which various types of external light are incident.

Therefore, an object of the invention is to improve visibility of a display apparatus when an illuminance amount by external light is high.

These and other objects, features, aspects and advantages of the invention will become more apparent from the following detailed description of the invention when taken in conjunction with the accompanying drawings.

DESCRIPTION OF THE EMBODIMENTS

Embodiments of the invention are hereinafter described with reference to the drawings.

1. Entire Configuration

Figure 1:
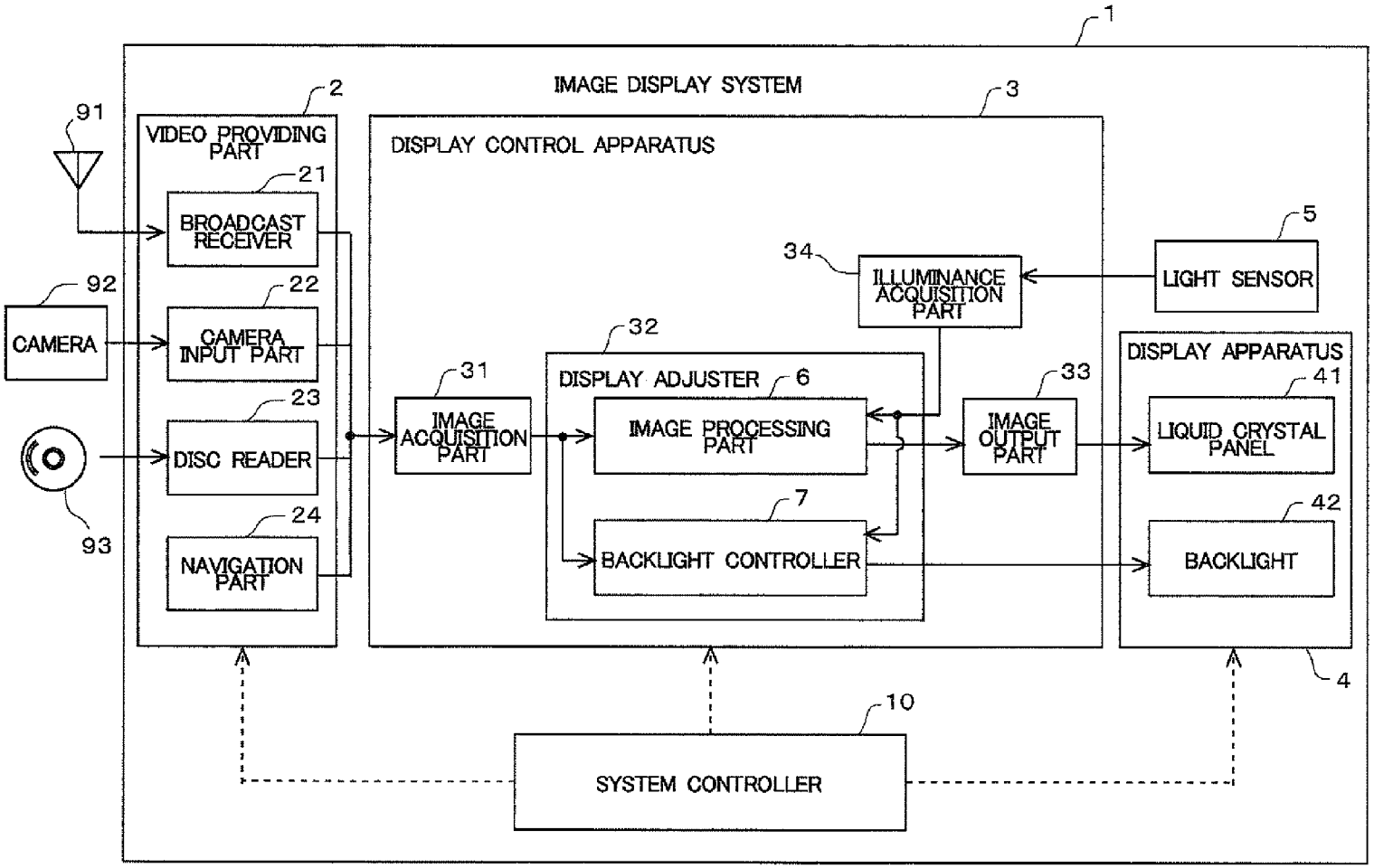
FIG. 1 is a block diagram illustrating a configuration of an image display system.

FIG. 1 is a block diagram illustrating a configuration of an image display system 1 in this embodiment. A navigation system for a vehicle, such as a car, is an example of the image display system 1. The image display system 1 for installation in a vehicle has a function of displaying various types of information for a user in a cabin of the vehicle.

As shown in FIG. 1, the image display system 1 includes a display apparatus 4 that displays various images, a display control apparatus 3 controls display on the display apparatus 4, a video providing part 2 that provides an image to be displayed on the display apparatus 4, and a light sensor 5 that detects an intensity of the external light.

The image display system 1 further includes a system controller 10 that controls the entire image display system 1. The system controller 10 is a microcomputer composed of, for example, a CPU, a RAM, a ROM and the like. Various control functions of controlling the entire system are implemented by arithmetic processing performed by the CPU of the system controller 10 in accordance with a predetermined program. The system controller 10 comprehensively controls the video providing part 2, the display control apparatus 3, the display apparatus 4, and the light sensor 5.

The video providing part 2 outputs a video signal including a target display image to be displayed on the display apparatus 4, from various video sources. The video providing part 2 includes a broadcast receiver 21, a camera input part 22, a disc reader 23, and a navigation part 24. Each of the broadcast receiver 21, the camera input part 22, the disc reader 23, and the navigation part 24 included in the video providing part 2 outputs the video signal including an image (frame) in a predetermined-time cycle (e.g., 1/30 sec.).

The broadcast receiver 21 decodes a signal of broadcast, such as television broadcast and data broadcast, received by an antenna 91 mounted on the vehicle, acquires an image representing a content of the broadcast received, and outputs the image acquired to the display control apparatus 3. The camera input part 22 is connected to a vehicle-mounted camera 92, and acquires an image representing surroundings of the vehicle captured by the vehicle-mounted camera 92, and then outputs the image acquired to the display control apparatus 3. The disc reader 23 reads a video disc 93, such as a DVD, and acquires an image representing a content recorded on the video disc 93, and then outputs the image acquired to the display control apparatus 3. Moreover, the navigation part 24 is an electronic substrate that provides a navigation function and outputs an image necessary for the navigation function, such as a map image for route guidance, to the display control apparatus 3.

The display apparatus 4 includes a liquid crystal panel 41 on which the image is displayed, and a backlight 42 that illuminates the liquid crystal panel 41. The image display system 1 is disposed on an instrument panel or the like in the vehicle such that the user that is a driver and/or a passenger of the vehicle can look at the liquid crystal panel 41 of the display apparatus 4. The liquid crystal panel 41 includes a plurality of dots, for example, arrayed in two dimensions of length and width. The liquid crystal panel 41 displays the image by changing a transmission of light output by the backlight 42 for each dot. Moreover, the backlight 42 includes a light source that emits light, and illuminates the liquid crystal panel 41 from behind thereof. It is preferable to use a light emitting diode (LED) of which pulsed light rises and falls very speedily, as the light source of the backlight 42.

The backlight 42 emits light based on a control signal transmitted from the display control apparatus 3. The control signal is a periodic signal alternating an on-time period and an off-time period. The backlight 42 emits light during the on-time period of the control signal and the backlight 42 does not emit light during the off-time period of the control signal. The higher a level of the control signal is, the greater a light emission intensity of the backlight 42 is. An amount of light (light amount) of the backlight 42 is obtained by multiplying the light emission intensity and a light emission time period of the backlight 42. Generally, the greater the light amount (light flux) of the backlight 42 per unit of time becomes, the brighter the screen of the display apparatus 4 becomes.

The light sensor 5 outputs a signal having a level according to an intensity of incident light. The light sensor 5 includes a light receiving element that detects the intensity of the incident light. The light receiving element is disposed in a vicinity of a rim portion of the liquid crystal panel 41 that is the screen of the display apparatus 4. Therefore, the light sensor 5 outputs the signal according to the intensity of the external light incident from a front on the screen of the display apparatus 4 (i.e., the external light exerting an influence on the visibility of the screen of the display apparatus 4).

The display control apparatus 3 is a hardware circuit such as an ASIC (Application Specific Integrated Circuit), and controls the display on the display apparatus 4. The display control apparatus 3 includes an illuminance acquisition part 34, an image acquisition part 31, a display adjuster 32 and an image output part 33.

The illuminance acquisition part 34 derives the illuminance amount by the external light, based on the level of the signal output from the light sensor 5. Thus the illuminance acquisition part 34 acquires the illuminance amount on the screen of the display apparatus 4 of which visibility is influenced by the external light. The illuminance acquisition part 34 outputs the illuminance amount by the external light acquired, to the display adjuster 32.

The image acquisition part 31 acquires the video signal including an image, from the video providing part 2. The image acquisition part 31 receives one of the video signals output from the broadcast receiver 21, the camera input part 22, the disc reader 23, and the navigation part 24 by switching the video signals based on a command from the system controller 10, and then provides an image included in the video signal received to the display adjuster 32.

The display adjuster 32 performs an adjustment control that adjusts a displaying state of the display apparatus 4. The display adjuster 32 adjusts the displaying state of the display apparatus 4 in accordance with the illuminance amount by the external light input from the illuminance acquisition part 34, and improves the visibility of the screen of the display apparatus 4. The display adjuster 32 performs at least one of control methods of correcting the target display image to be displayed on the display apparatus 4 and of controlling light emission of the backlight 42, and adjusts the displaying state of the display apparatus 4.

The image output part 33 outputs the image corrected by the display adjuster 32 to the display apparatus 4 and causes the display apparatus 4 to display the image corrected. Thus, the image corrected by the display adjuster 32 is displayed on the liquid crystal panel 41 of the display apparatus 4.

The display adjuster 32 includes a backlight controller 7 that controls the light emission of the backlight 42. The backlight controller 7 controls the light emission of the backlight 42 by generating a control signal of which duty cycle (a percentage of the on-time period in a cycle) and of which level have been adjusted, and by outputting the control signal to the backlight 42.

Figure 2:
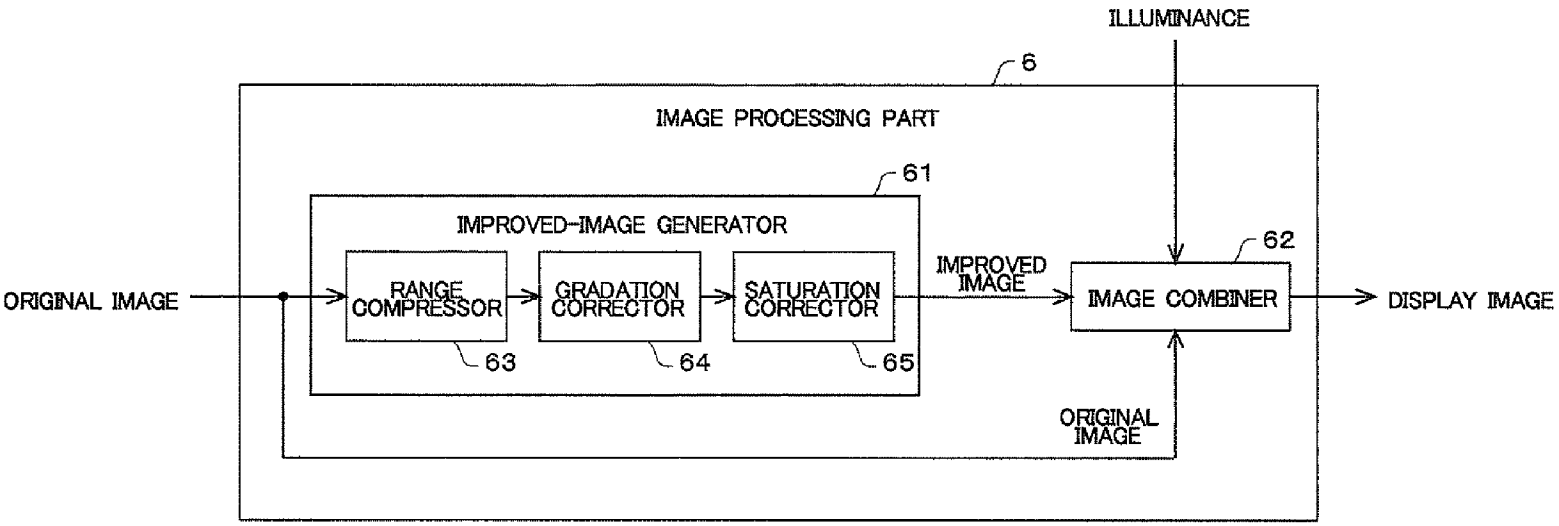
FIG. 2 illustrates a detailed configuration of an image processing part.

The display adjuster 32 further includes an image processing part 6 that corrects the target display image to be displayed on the display apparatus 4. FIG. 2 illustrates a detailed configuration of the image processing part 6. The image processing part 6 mainly includes an improved-image generator 61 and an image combiner 62.

The improved-image generator 61 performs predetermined image processing to an original image that is a pre-correction image input from the video providing part 2 and generates an improved image of which visibility has been improved when the illuminance amount by the external light is relatively high. The improved-image generator 61 includes a range compressor 63, a gradation corrector 64, and a saturation corrector 65. Detailed functions thereof are described later.

Moreover, the image combiner 62 generates a display image by using at least one of the original image and the improved image generated by the improved-image generator 61. Normally, the image combiner 62 generates the display image by combining the original image and the improved image. Thus the display image generated by using the improved image is displayed on the display apparatus 4.

2. Displaying State Adjustment

The image display system 1 repeats a process where the display control apparatus 3 processes an image in the video signal provided by the video providing part 2, and where the display apparatus 4 displays the image processed, in a cycle (e.g., in a 1/30 sec-cycle) where the video signal includes an image. In this process, the display adjuster 32 performs the adjustment control that adjusts the displaying state of the display apparatus 4 in accordance with the illuminance amount by the external light exerting an influence on the screen of the display apparatus 4, and improves the visibility of the screen of the display apparatus 4. The display adjuster 32 changes types of the adjustment control to be performed in accordance with the illuminance amount by the external light.

Figure 3:
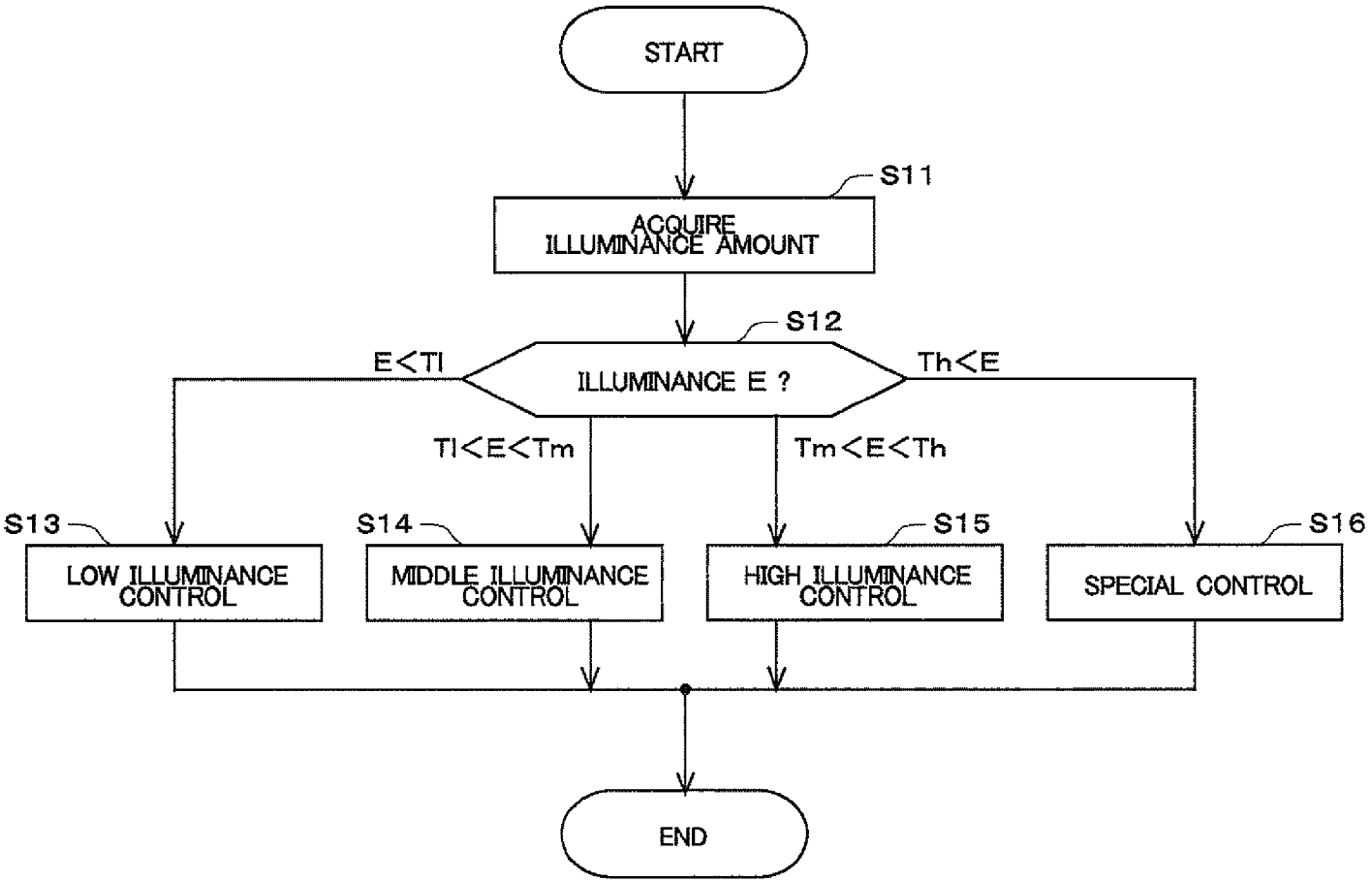
FIG. 3 is a flowchart of a process performed by a display adjuster.

FIG. 3 illustrates the basic process performed by the display adjuster 32. The display adjuster 32 repeats the process shown in FIG. 3 each time when the target display image is input.

The display adjuster 32 first acquires the illuminance amount by the external light from the illuminance acquisition part 34 (a step S11). Next, the display adjuster 32 compares the illuminance amount by the external light with three predetermined thresholds (a step S12). The three thresholds are a low threshold Tl, a middle threshold Tm, and a high threshold Th (Tl<Tm<Th). The display adjuster 32 selects one from amongst a plurality of types of the adjustment control that adjusts the displaying state of the display apparatus 4, based on a result of the comparison of the illuminance amount by the external light and the three thresholds Tl, Tm, and Th. Then the display adjuster 32 performs the adjustment control selected. The illuminance amount by the external light is hereinafter referred to as illuminance E.

When the illuminance E is lower than the low threshold Tl (E<Tl), the display adjuster 32 performs a low illuminance control that is one type of the adjustment control (a step S13). When the illuminance E is higher than the low threshold Tl and lower than the middle threshold Tm (Tl<E<Tm), the display adjuster 32 performs a middle illuminance control that is one type of the adjustment control (a step S14). Moreover, when the illuminance E is higher than the middle threshold Tm and lower than the high threshold Th (Tm<E<Th), the display adjuster 32 performs a high illuminance control that is one type of the adjustment control (a step S15). Furthermore, when the illuminance E is higher than the high threshold Th (Th<E), the display adjuster 32 performs a special control that is one type of the adjustment control (a step S16). When the illuminance E is the same as the low threshold Tl, the middle threshold Tm, or the high threshold Th, either one of two applicable types of the adjustment control can be chosen and be performed.

Figure 4:
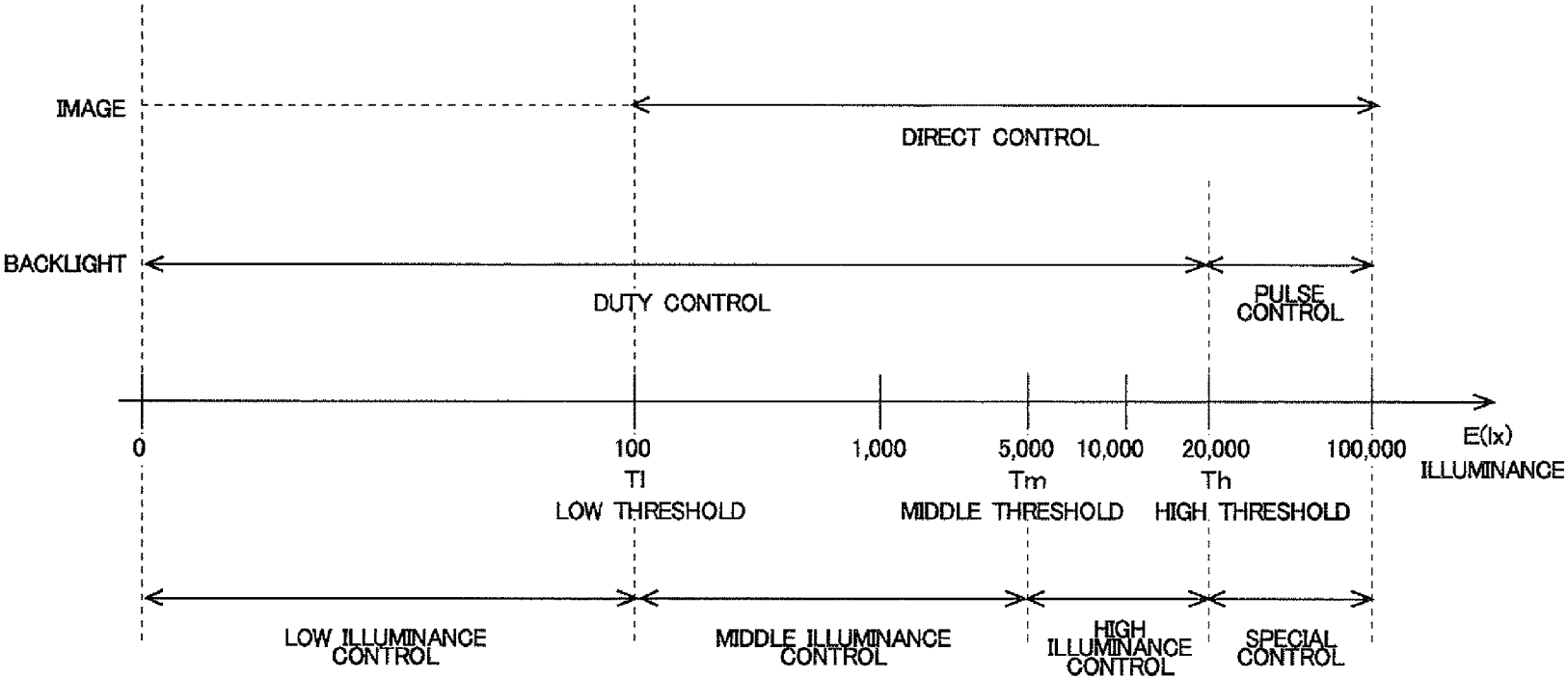
FIG. 4 illustrates a relationship between an illuminance amount by external light and an adjustment control.

FIG. 4 illustrates a relationship between the illuminance amount by the external light and the types of the adjustment control to be performed. The illuminance acquisition part 34 is operable to detect the illuminance amount by the external light, for example, in a range from 0 (zero) to 100,000 1×. The display adjuster 32 performs the adjustment control when the illuminance amount by the external light is in the range. As shown in FIG. 4, in the embodiment, for example, the low threshold Tl is set at 100 1×, the middle threshold Tm is set at 5,000 1×, and the high threshold Th is set at 20,000 1×.

In each type of the adjustment control, at least one of the control that corrects the target display image and the control that controls the light emission of the backlight 42, is performed. The image processing part 6 performs the control that corrects the target display image. The backlight controller 7 performs the control that controls the light emission of the backlight 42. The control that corrects the target display image includes a direct light control. The control that controls the light emission of the backlight 42 includes a duty cycle control and a pulse control.

As shown in FIG. 4, the direct light control is performed when the illuminance amount by the external light is higher than the low threshold Tl (Tl<E). The duty cycle control is performed when the illuminance amount by the external light is lower than the high threshold Th (E<Th). Moreover, the pulse control is performed when the illuminance amount by the external light is higher than the high threshold Th (Th<E).

Therefore, only the duty cycle control is performed in the low illuminance control. The low illuminance control is also referred to as a dimmer control. In the middle illuminance control and in the high illuminance control, the direct light control and the duty cycle control are performed in combination. Moreover, in the special control, the direct light control and the pulse control are performed in combination.

As described above, the displaying state of the display apparatus 4 can be appropriately adjusted in a wide rage of the illuminance amount by the external light, by changing the types of the adjustment control precisely in accordance with the illuminance amount by the external light. Thus, the visibility of the screen of the display apparatus 4 can be improved even in a vehicle in which the screen is exposed to various types of external light. Individual control details of the direct light control, the duty cycle control, and the pulse control are hereinafter concretely described.

3. Direct Light Control

First, the direct light control is described. As described above, the direct light control is performed when the illuminance E is higher than the low threshold Tl (Tl<E). The illuminance amount by the external light increases to some degree, the visibility of the screen of the display apparatus 4 is reduced due to reflection of the external light on the screen, etc. Concretely, a range in which a user can recognize difference in gradation of an image displayed on the display apparatus 4 becomes narrower, and the gradation of the image is substantially lost, especially in a relatively low-bright area of the image. Moreover, colors of an object on the image displayed on the display apparatus 4 become pale entirely.

Therefore, in the direct light control, the improved-image generator 61 of the image processing part 6 (refer to FIG. 2) compresses a dynamic range to express the gradation in the range in which user can recognize the difference in the gradation, and generates the improved image of which saturation has been enhanced to sharpen the colors of the subject. Then the visibility of the screen of the display apparatus 4 is improved by displaying a display image obtained by combining the improved image generated and the original image.

Figure 5:
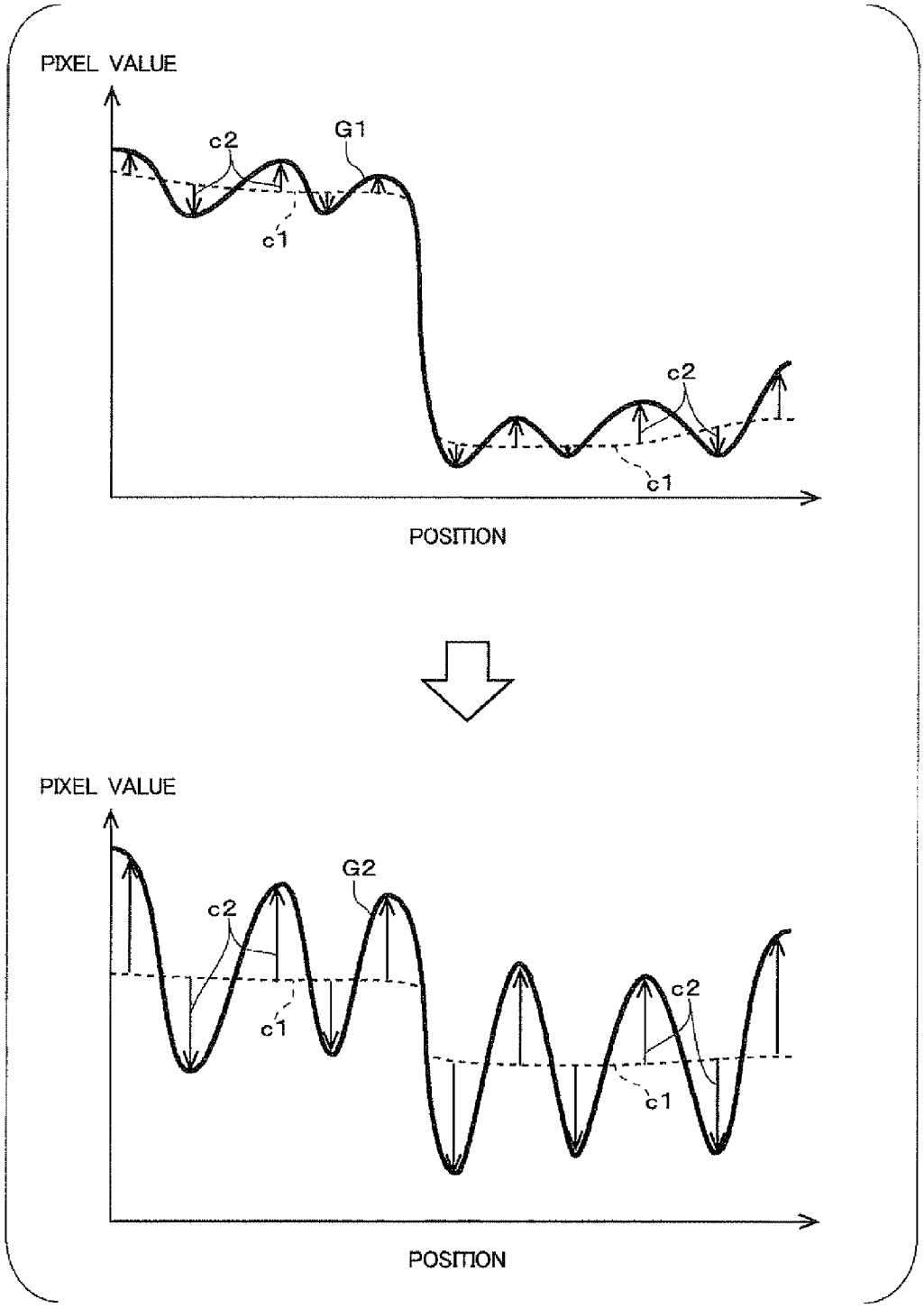
FIG. 5 illustrates a process performed by a range compressor.

The range compressor 63 of the improved-image generator 61 compresses the dynamic range of the original image. As shown in the upper drawing of FIG. 5, a value of each pixel of an original image G1 can be regarded as a combination of an illumination component c1 that illuminates an object and a reflectance component c2. As shown in the lower drawing of FIG. 5, the range compressor 63 suppresses the illumination component c1 (reduces contrast between bright and dark of an entire image) while increasing the reflectance component c2 (increases a range of the gradation for each object). Thus the range compressor 63 generates an improved image G2 by compressing the dynamic range of the original image. Difference in the gradation even in a significantly-bright area and in a significantly-dark area of the improved image G2 becomes clear and the visibility is improved.

The illumination component c1 can be extracted by using a low-pass filter because the illumination component c1 corresponds to a low-frequency component of the original image. Moreover, the reflectance component c2 is regarded as a remaining component (high-frequency component) obtained by removing the low-frequency component from the original image. Based on this principle, the range compressor 63 is operable to separate the original image into the illumination component and the reflectance component, and to perform individual processes for the components.

Figure 6:
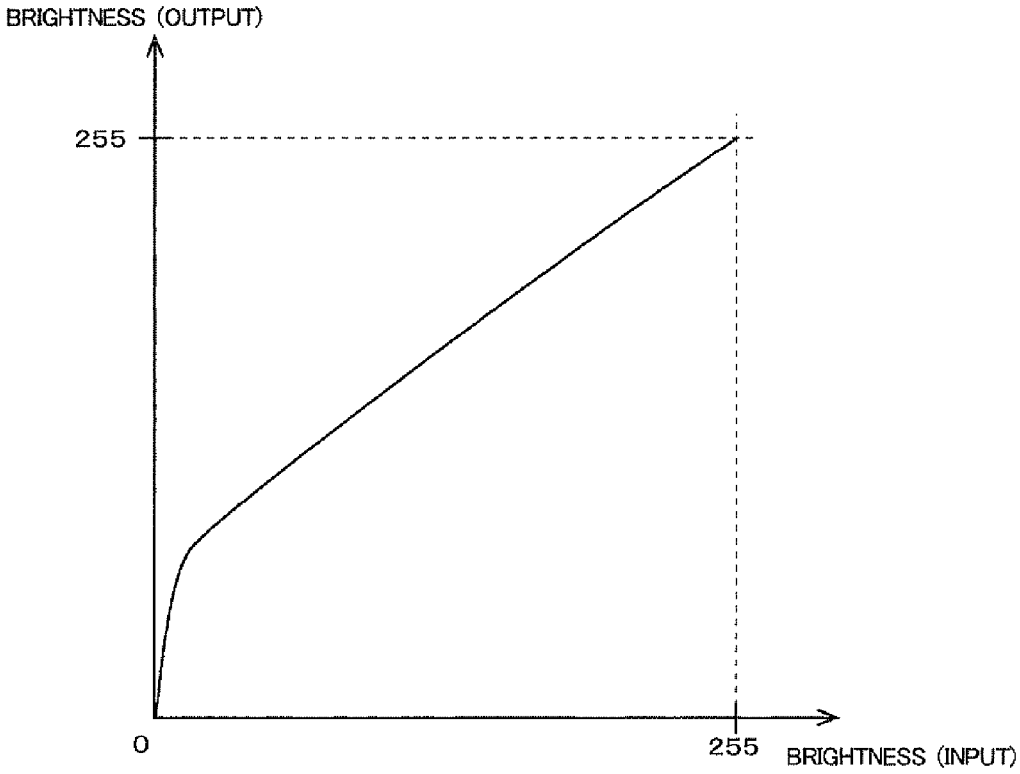
FIG. 6 illustrates a tone curve used by a gradation corrector.

A gradation corrector 64 corrects the gradation of the improved image processed by the range compressor 63. Concretely, the gradation corrector 64 corrects brightness of the improved image by using a tone curve shown in FIG. 6, and increases brightness of a relatively low-bright area in which the gradation may be lost. Thus, a user can clearly recognize the difference in the gradation in the relatively low-bright area of the improved image. Moreover, the saturation corrector 65 enhances saturation of the improved image processed by the gradation corrector 64. Thus the colors of the subject in the improved image become clear.

The image combiner 62 generates the display image by combining the improved image generated in the manner mentioned above and the original image. A combining ratio between the improved image and the original image is determined in accordance with the illuminance E. Therefore, the visibility of the screen of the display apparatus 4 can be improved in accordance with the illuminance E by displaying the display image on the display apparatus 4.

Figure 7:
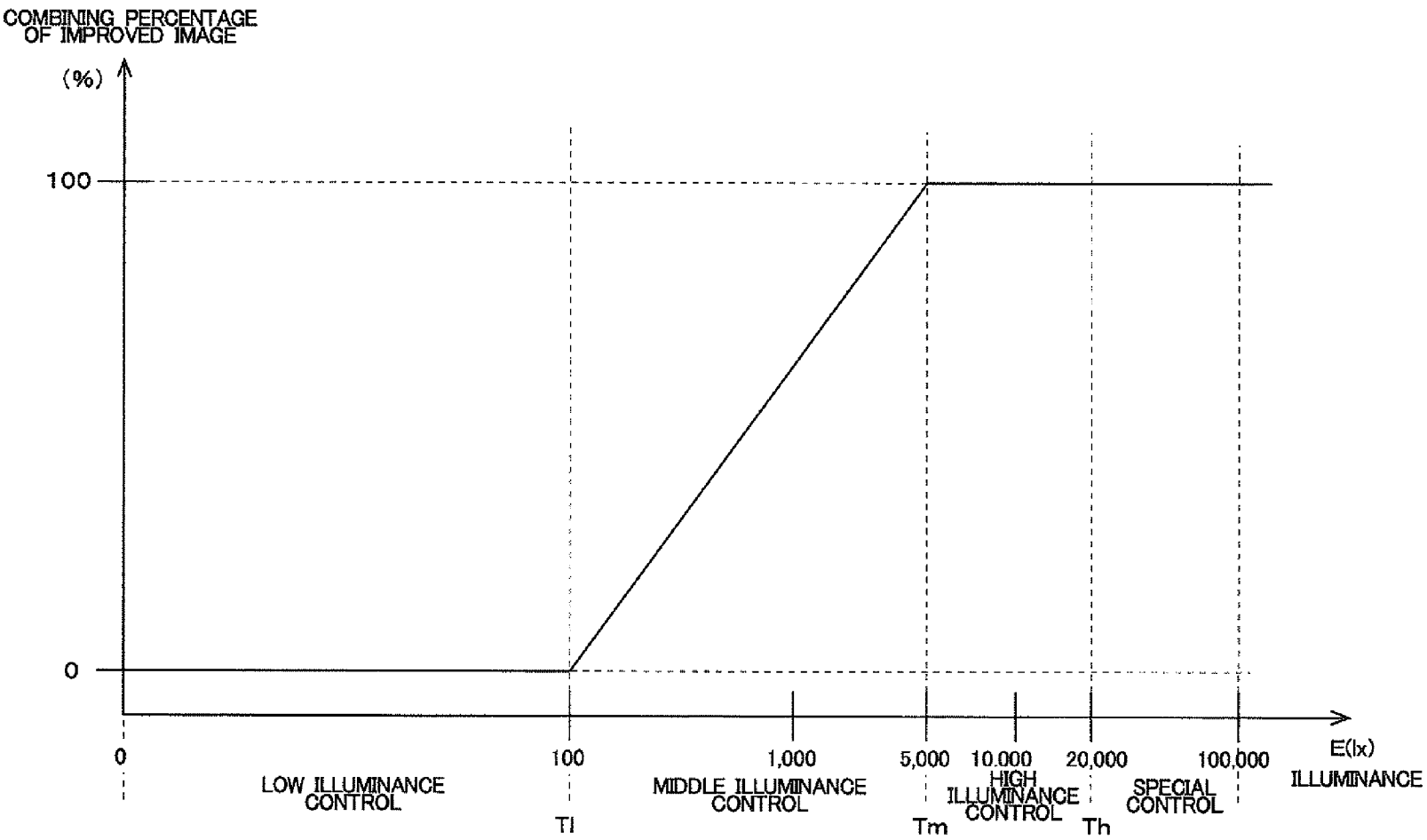
FIG. 7 illustrates a relationship between the illuminance amount by the external light and a combining percentage of an improved image.

FIG. 7 illustrates a relationship between the illuminance E and a combining percentage (%) of the improved image. As shown in FIG. 7, when the illuminance E is higher than the low threshold Tl and lower than the middle threshold Tm (Tl<E<Tm), the combining percentage of the improved image is set higher in a range of 0% to 100% as the illuminance E becomes higher. In other words, in the middle illuminance control, the combining ratio between the improved image and the original image is determined such that a combining percentage of the original image decreases and the combining percentage of the improved image increases as the illuminance E becomes higher.

Moreover, when the illuminance E is higher than the middle threshold Tm (Tm<E), the combining percentage of the improved image is fixed at 100%. In other words, in the high illuminance control and in the special control, the display image is generated by using only the improved image. When the illuminance E is lower than the low threshold Tl (E<Tl), the direct light control is not performed. Thus the combining percentage of the improved image is 0%, and the display image is generated by using only the original image.

4. Duty Cycle Control

Next, the duty cycle control is described. When the illuminance E is relatively low, the screen of the display apparatus 4 is too bright for a user because the screen is much brighter as compared to surrounding environment, and thus the visibility of the screen of the display apparatus 4 is reduced. On the other hand, when the illuminance E is relatively high, the visibility of the screen of the display apparatus 4 is reduced due to reflection of the external light on the screen, etc. Therefore, in the duty cycle control, the backlight controller 7 improves the visibility of the screen of the display apparatus 4 by decreasing the light amount of the backlight 42 when the illuminance E is relatively low, or by increasing the light amount of the backlight 42 when the illuminance E is relatively high.

The backlight controller 7 changes the duty cycle of the control signal while maintaining the level of the control signal constant, in the duty cycle control. Thus the backlight controller 7 adjusts the light amount of the backlight 42 per unit of time.

Figure 8:
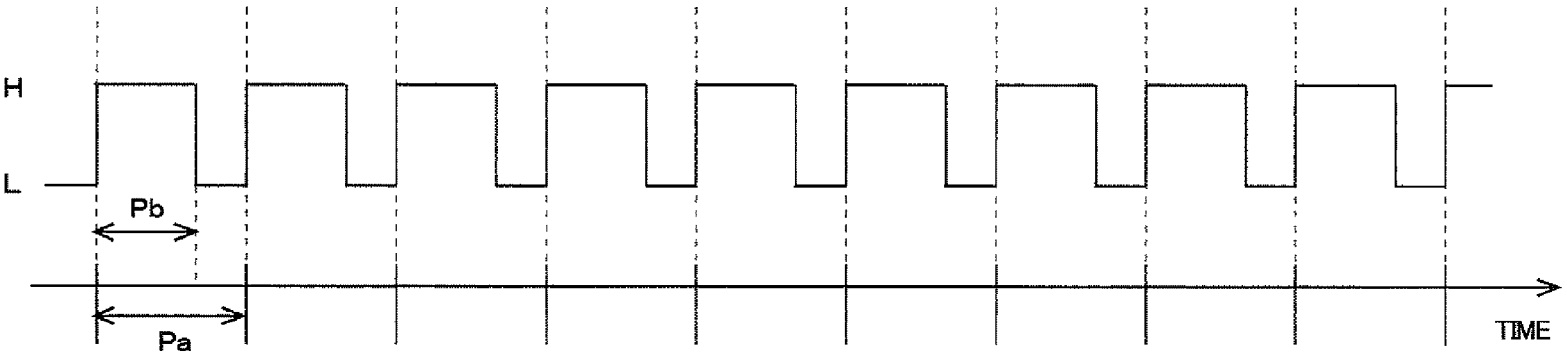
FIG. 8 illustrates a waveform of a control signal used in a duty cycle control.

FIG. 8 illustrates an exemplar waveform of a control signal used in the duty cycle control. As shown in FIG. 8, the control signal is a cyclic signal that alternates between the on-time period in which the control signal is "high (H)" and the off-time period in which the control signal is "low (L)." The frequency of the control signal is, for example, 240 Hz. The level of the control signal (a level H) is constant. The duty cycle is a ratio of an on-time period Pb to a time required for one cycle Pa of the control signal. The backlight controller 7 changes the duty cycle of the control signal in accordance with the illuminance E.

Figure 9:
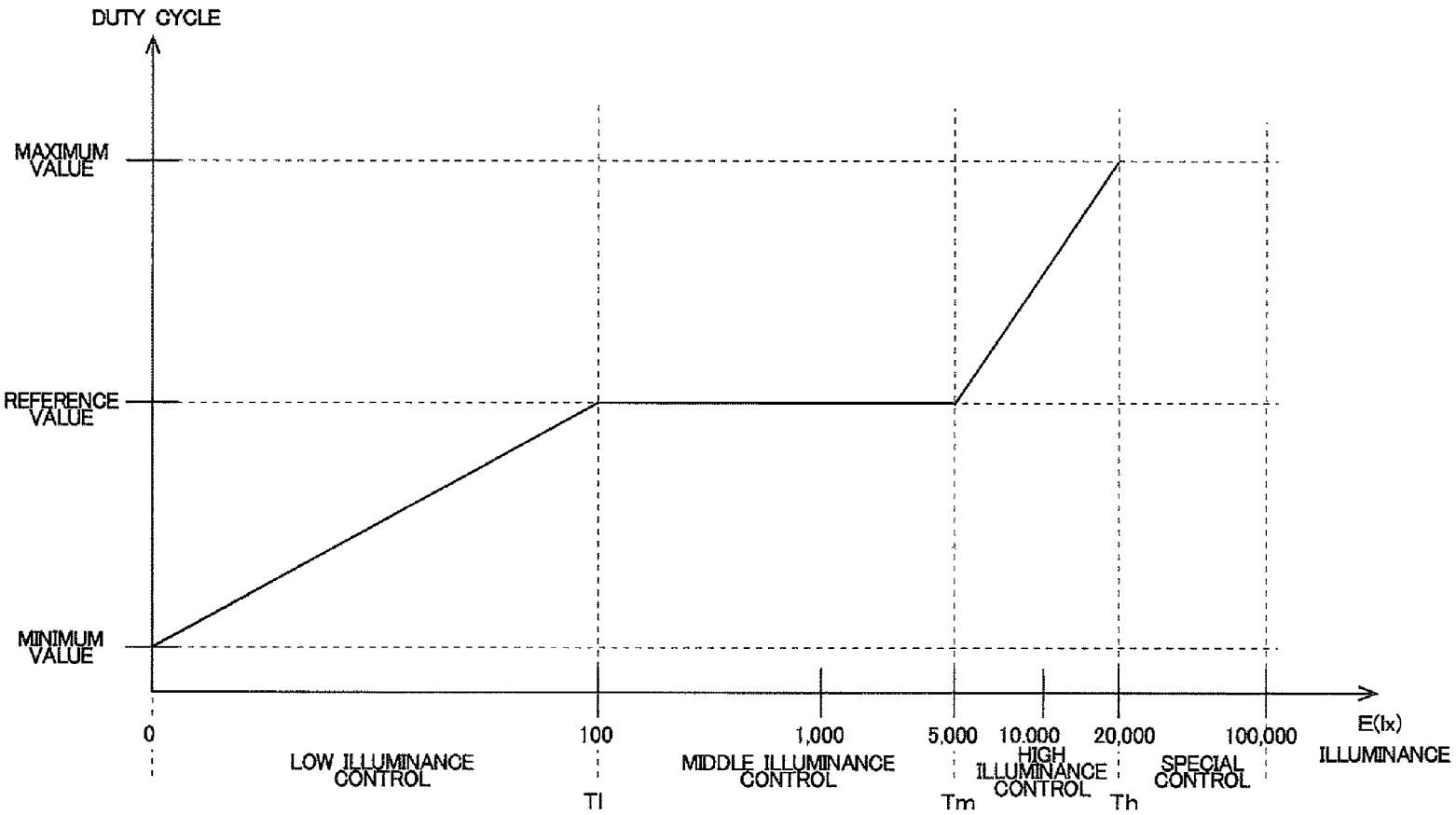
FIG. 9 illustrates a relationship between the illuminance amount by the external light and a duty cycle.

FIG. 9 illustrates a relationship between the illuminance E and the duty cycle. As shown in FIG. 9, when the illuminance E is lower than the low threshold Tl (E<Tl), the duty cycle is set at a value in a range from a minimum value to a reference value, in accordance with the illuminance E. In other words, in the low illuminance control (dimmer control), the duty cycle is set lower than the reference value, and the lower the illuminance E is, the lower the duty cycle is set.

When the illuminance E is higher than the low threshold Tl and lower than the middle threshold Tm (Tl<E<Tm), the duty cycle is set at the reference value. In other words, in the middle illuminance control, the duty cycle is fixed at the reference value regardless of the illuminance E. Therefore, the visibility is improved mainly by the direct light control, in the middle illuminance control.

When the illuminance E is higher than the middle threshold Tm and lower than the high threshold Th (Tm<E<Th), the duty cycle is set at a value in a rage from the reference value to a maximum value, in accordance with the illuminance E. In other words, in the high illuminance control, the duty cycle is set higher than the reference value, and the higher the illuminance E is, the higher the duty cycle is. When the illuminance E is higher than the high threshold Th (Th<E), the duty cycle control is not performed.

The minimum value and the maximum value are set in advance. For example, the minimum value is set at 10% and the maximum value is set at 100%. Moreover, the backlight controller 7 sets the reference value in a range from 20% to 80%, in accordance with an averaged brightness of the target display image. The backlight controller 7 sets the reference value at a higher value as the average brightness of the target display image becomes higher.

5. Pulse Control

Next, the pulse control is described. As described above, the pulse control is performed instead of the duty cycle control, when the illuminance E is higher than the high threshold Th (Th<E). A case where the illuminance E is higher than the high threshold Th (Th<E) represents a case where relatively strong direct sunlight is incident on the screen of the display apparatus 4.

In the duty cycle control, the backlight controller 7 adjusts the light amount of the backlight 42 by changing the duty cycle of the control signal while maintaining the level of the control signal constant. On the other hand, in the pulse control, the backlight controller 7 makes the level of the control signal higher than the level of the control signal in the duty cycle while fixing the duty cycle of the control signal at a relatively low value. Thus the backlight controller 7 causes the backlight 42 to periodically emit a pulsed light.

Figure 10:
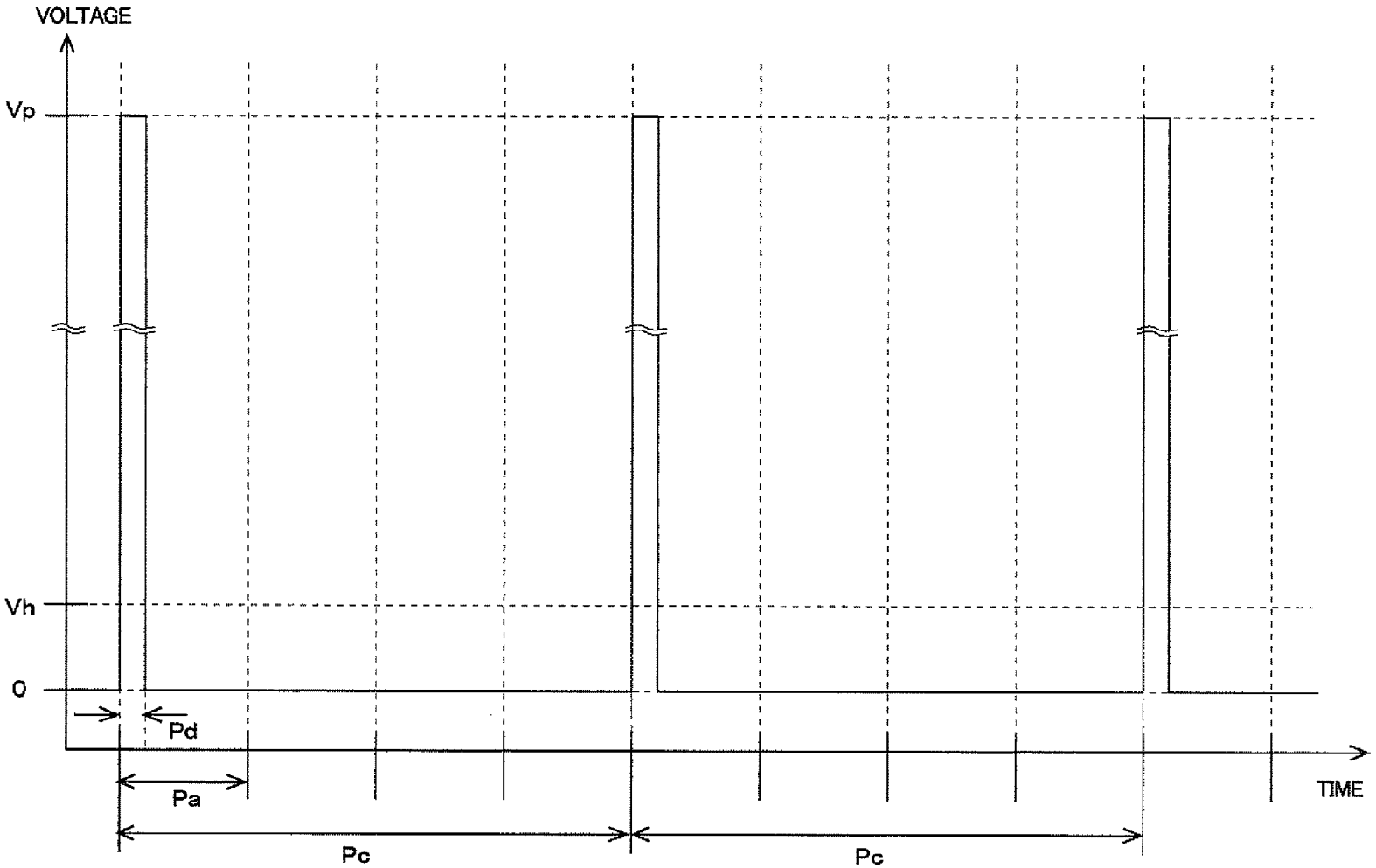
FIG. 10 illustrates a waveform of a control signal used in a pulse control.

FIG. 10 illustrates an exemplar waveform of the control signal used in the pulse control. As shown in FIG. 10, the control signal includes a relatively narrow-width pulse (rectangular wave pulse) in a predetermined-time cycle. It is preferable that the frequency of the control signal in the pulse control is in a range from 60 Hz to 100 Hz. In this embodiment, the frequency of the control signal is set at 60 Hz. Therefore, one cycle Pc for the control signal in the pulse control is four times longer than one cycle Pa in the duty cycle control.

A level Vp (a level in the pulse control) of the control signal is set sufficiently higher than a level Vh (level H) of the control signal in the duty cycle control. In this embodiment, the level Vp of the control signal is set such that a light emission intensity of the backlight 42 in the pulse control is twenty times higher than the light emission intensity in the duty cycle control.

Moreover, the duty cycle of the control signal (a ratio of a pulse width Pd to one cycle Pc) is fixed at a relatively low value. It is preferable that the duty cycle in the pulse control is 10% or lower (equal to or lower than the minimum value in the duty cycle control). In this embodiment, the duty cycle is fixed at 5% that is one-twentieth (1/20) of the maximum value 100% in the duty cycle control.

The backlight 42 emits light based on the control signal as described above. Therefore, the backlight 42 periodically emits a short pulsed light having a high intensity, at 60 Hz. Such a driving method of the backlight 42 is hereinafter referred to as a "pulse drive."

The pulse drive is compared with a drive (hereinafter referred to as "direct current drive") of the backlight 42 when the duty cycle is set at the maximum value (100%) in the duty cycle control (i.e., when the backlight 42 is applied with a direct current voltage). In this embodiment, the light emission intensity in the pulse drive is twenty times higher than the light emission intensity in the direct drive and the duty cycle in the pulse drive is one-twentieth of the duty cycle in the direct drive. Therefore, the light amount (luminous flux) of the backlight 42 per unit of time in the pulse drive is the same as the light amount in the direct current drive. Thus energy for the light emission of the backlight 42 in the pulse drive is the same as energy for the light emission of the backlight 42 in the direct current drive.

When seeing a momentary strong light (pulsed light), a human being perceives the light several times brighter than actual brightness of the light (Broca-Sulzer effect). Therefore, even when the light amount of the backlight 42 per unit of time in the pulse drive is the same as the light amount of the backlight 42 in the direct current drive, a user perceives that the screen of the display apparatus 4 in the pulse drive is approximately 1.5 times to 2.7 times brighter than the screen of the display apparatus 4 in the direct current drive.

Based on the principle, in a range where the backlight 42 is operable to emit light, the pulse control can make the brightness of the screen of the display apparatus 4 brighter than the duty cycle control can. Therefore, even when the illuminance E is higher than the high threshold Th (Th<E) (when incident direct sunlight is relatively high), the visibility of the display apparatus 4 can be improved.

As described above, the improved-image generator 61 of the image display system 1 generates the improved image by compressing the dynamic range of the original image, for display on the display apparatus 4. Then the image output part 33 outputs the display image generated by using the improved image to the display apparatus 4, and the display image is displayed on the display apparatus 4. Moreover, the illuminance acquisition part 34 acquires the illuminance amount by the external light exerting an influence on the screen of the display apparatus 4. The backlight controller 7 controls the light emission of the backlight 42 by providing the periodic control signal to the backlight 42 that illuminates the screen of the display apparatus 4.

When the illuminance E is lower than the high threshold Th (E<Th), the backlight controller 7 performs the duty cycle control that adjusts the light amount of the backlight 42 by changing the duty cycle of the control signal according to the illuminance amount by the external light while maintaining the level of the control signal constant. Moreover, when the illuminance E is higher than the high threshold Th (Th<E), the backlight controller 7 performs the pulse control that causes the backlight 42 to periodically emit the pulsed light, by making the level of the control signal higher than the level of the control signal in the duty cycle control while fixing the duty cycle of the control signal at a value equal to or lower than a predetermined value (e.g., 10%). Thus, by performing the pulse control, the user perceives the screen of the display apparatus 4 brighter than the screen of the display apparatus 4 in the duty cycle control, and the visibility of the display apparatus 4 can be improved when the illuminance amount by the external light is high.

6. Modifications

An embodiment of the invention is described above. However, the invention is not limited to the above-described embodiment, but various modifications are possible. Some of the various modifications are hereinafter described. All modes including the embodiment described above and the modifications described below may be optionally combined.

In the aforementioned embodiment, the light amount (luminous flux) of the backlight 42 per unit of time in the pulse drive and the energy relating to light emission of the backlight 42 are the same as the light amount and the energy in the direct current drive. However, the light amount and the energy in the pulse drive may be lower than the light amount and the energy in the direct current drive.

Moreover, in the aforementioned embodiment, the image display system 1 for installation in a vehicle is described. However, the invention described in the aforementioned embodiment is appropriately applicable to any image display system, such as a mobile phone and a smartphone, which is used in the environment where the image display system is exposed to various types of the external light.

In the aforementioned embodiments, a part of functions implemented by a hardware circuit may be implemented by software.

While the invention has been shown and described in detail, the foregoing description is in all aspects illustrative and not restrictive. It is therefore understood that numerous other modifications and variations can be devised without departing from the scope of the invention.

What is claimed is:

1. A display control apparatus that controls a display apparatus, the display control apparatus comprising:

an acquisition part that acquires an illuminance amount by external light on a screen of the display apparatus;

a first generator that generates a correction image by compressing a dynamic range of an original image for display on the display apparatus;

an output part that outputs a display image generated by using at least one of the original image or the correction image, to the display apparatus, and that causes the display image to be displayed on the display apparatus; and a controller that provides a periodic control signal to a backlight illuminating the screen so as to control light emission of the backlight, wherein, when E denotes the illuminance amount by the external light and when Th denotes a threshold relating to the illuminance amount by the external light, in a case where E<Th, the controller performs a first control that adjusts an amount of light of the backlight by changing a duty cycle of the control signal in accordance with the illuminance amount by the external light while maintaining a magnitude of the control signal constant, and in a case where Th<E, the controller performs a second control that causes the backlight to periodically emit a pulsed light by making a magnitude of the control signal in the second control higher than the magnitude of the control signal in the first control while fixing the duty cycle of the control signal in the second control.

2. The display control apparatus according to claim 1, wherein:

the controller fixes the duty cycle of the control signal at a value of 10% or lower when the second control is performed.

3. The display control apparatus according to claim 1, further comprising:

a second generator that generates the display image by combining the original image and the correction image in a combining ratio determined in accordance with the illuminance amount by the external light.

4. The display control apparatus according to claim 3, wherein:

when Tl and Tm denote two thresholds different from Th relating to the illuminance amount by the external light, and when Tl<Tm<Th, in a case where Tm<E, the second generator generates the display image using only the correction image, in a case where Tl<E<Tm, the second generator generates the display image by combining the original image and the correction image, while increasing a percentage of the correction image, as the illuminance amount by the external light becomes higher, and in a case where E<Tl, the second generator generates the display image using only the original image.

5. The display control apparatus according to claim 4, wherein:

in a case where Tm<E<Th, the controller changes the duty cycle in a range from a reference value to a maximum value, in a case where Tl<E<Tm, the controller fixes the duty cycle at the reference value, and in a case where E<Tl, the controller changes the duty cycle in a range from a minimum value to the reference value.

6. The display control apparatus according to claim 1, wherein:

when Tl and Tm denote two thresholds different from Th relating to the illuminance amount by the external light, and when Tl<Tm<Th, in a case where Tm<E<Th, the controller changes the duty cycle in a range from a reference value to a maximum value, in a case where Tl<E<Tm, the controller fixes the duty cycle at the reference value, and in a case where E<Tl, the controller changes the duty cycle in a range from a minimum value to the reference value.

7. The display control apparatus according to claim 1, wherein:

the display apparatus is an apparatus for installation in a vehicle.

8. An image display system comprising:

a display apparatus;

an acquisition part that acquires an illuminance amount by external light on a screen of the display apparatus;

a first generator that generates a correction image by compressing a dynamic range of an original image for display on the display apparatus;

an output part that outputs a display image generated by using at least one of the original image or the correction image, to the display apparatus, and that causes the display image to be displayed on the display apparatus; and a controller that provides a periodic control signal to a backlight illuminating the screen so as to control light emission of the backlight, wherein, when E denotes the illuminance amount by the external light and when Th denotes a threshold relating to the illuminance amount by the external light, in a case where E<Th, the controller performs a first control that adjusts an amount of light of the backlight by changing a duty cycle of the control signal in accordance with the illuminance amount by the external light while maintaining a magnitude of the control signal constant, and in a case where Th<E, the controller performs a second control that causes the backlight to periodically emit a pulsed light by making a magnitude of the control signal in the second control higher than the magnitude of the control signal in the first control while fixing the duty cycle of the control signal in the second control.

9. The image display system according to claim 8, wherein:

the controller fixes the duty cycle of the control signal at a value of 10% or lower when the second control is performed.

10. The image display system according to claim 8, further comprising:

a second generator that generates the display image by combining the original image and the correction image in a combining ratio determined in accordance with the illuminance amount by the external light.

11. The image display system according to claim 10, wherein:

when Tl and Tm denote two thresholds different from Th relating to the illuminance amount by the external light, and when Tl<Tm<Th, in a case where Tm<E, the second generator generates the display image using only the correction image, in a case where Tl<E<Tm, the second generator generates the display image by combining the original image and the correction image, while increasing a percentage of the correction image, as the illuminance amount by the external light becomes higher, and in a case where E<Tl, the second generator generates the display image using only the original image.

12. The image display system according to claim 11, wherein:

in a case where Tm<E<Th, the controller changes the duty cycle in a range from a reference value to a maximum value, in a case where Tl<E<Tm, the controller fixes the duty cycle at the reference value, and in a case where E<Tl, the controller changes the duty cycle in a range from a minimum value to the reference value.

13. The image display system according to claim 8, wherein:

when Tl and Tm denote two thresholds different from Th relating to the illuminance amount by the external light, and when Tl<Tm<Th, in a case where Tm<E<Th, the controller changes the duty cycle in a range from a reference value to a maximum value, in a case where Tl<E<Tm, the controller fixes the duty cycle at the reference value, and in a case where E<Tl, the controller changes the duty cycle in a range from a minimum value to the reference value.

14. The image display system according to claim 8, wherein:

the display apparatus is an apparatus for installation in a vehicle.

15. A display control method of controlling a display apparatus, the display control method comprising the steps of:

(a) acquiring an illuminance amount by external light on a screen of the display apparatus;

(b) generating a correction image by compressing a dynamic range of an original image for display on the display apparatus;

(c) displaying a display image generated by using at least one of the original image or the correction image, on the display apparatus; and (d) providing a periodic control signal to a backlight illuminating the screen so as to control light emission of the backlight, wherein when E denotes the illuminance amount by the external light and when Th denotes a threshold relating to the illuminance amount by the external light, in a case where E<Th, step (d) further comprises performing a first control that adjusts an amount of light of the backlight by changing a duty cycle of the control signal in accordance with the illuminance amount by the external light while maintaining a magnitude of the control signal constant, and in a case where Th<E, step (d) further comprises performing a second control that causes the backlight to periodically emit a pulsed light by making a magnitude of the control signal in the second control higher than the magnitude of the control signal in the first control while fixing the duty cycle of the control signal in the second control.

16. The display control method according to claim 15, wherein:

step (d) further comprises fixing the duty cycle of the control signal at a value of 10% or lower when the second control is performed.

17. The display control method according to claim 15, further comprising:

(e) generating the display image by combining the original image and the correction image in a combining ratio determined in accordance with the illuminance amount by the external light.

18. The display control method according to claim 17, wherein:

when Tl and Tm denote two thresholds different from Th relating to the illuminance amount by the external light, and when Tl<Tm<Th, in a case where Tm<E, step (e) further comprises generating the display image using only the correction image, in a case where Tl<E<Tm, step (e) further comprises generating the display image by combining the original image and the correction image while increasing a percentage of the correction image as the illuminance amount by the external light becomes higher, and in a case where E<Tl, step (e) further comprises generating the display image using only the original image.

19. The display control method according to claim 15, wherein:

when Tl and Tm denote two thresholds different from Th relating to the illuminance amount by the external light, and when Tl<Tm<Th, in a case where Tm<E<Th, step (d) further comprises changing the duty cycle in a range from a reference value to a maximum value, in a case where Tl<E<Tm, step (d) further comprises fixing the duty cycle at the reference value, and in a case where E<Tl, the step (d) further comprises changing the duty cycle in a range from a minimum value to the reference value.

20. The display control method according to claim 15, wherein:

the display apparatus is an apparatus for installation in a vehicle.

* * * * *